US008893606B2

(12) United States Patent
Gavish et al.

(10) Patent No.: US 8,893,606 B2
(45) Date of Patent: Nov. 25, 2014

(54) ARMOR ELEMENT AND AN ARMOR MODULE COMPRISING THE SAME

(75) Inventors: Ilan Gavish, Karmiel (IL); Amit Viesel, D.N. Marom Hagalil (IL); Shmuel Genihovich, D.N. Merom Hagalil (IL); Amir Ben Shoshan, D.N. Chevel Korazim (IL)

(73) Assignee: Plasan Sasa Ltd., M.P. Marom Hagalil (IL)

( * ) Notice: Subject to any disclaimer, the term of this patent is extended or adjusted under 35 U.S.C. 154(b) by 96 days.

(21) Appl. No.: 13/489,993

(22) Filed: Jun. 6, 2012

(65) Prior Publication Data

US 2014/0007762 A1 Jan. 9, 2014

(30) Foreign Application Priority Data

Jun. 6, 2011 (IL) ..... 213397
Jul. 7, 2011 (IL) ..... 213972

(51) Int. Cl.

| | |
|---|---|
| ***F41H 5/02*** | (2006.01) |
| ***F41H 5/04*** | (2006.01) |
| ***F41H 5/24*** | (2006.01) |
| ***F41H 7/00*** | (2006.01) |

(52) U.S. Cl.

CPC ..... *F41H 5/02* (2013.01); *F41H 5/0492* (2013.01); *F41H 5/24* (2013.01); *F41H 7/00* (2013.01)

USPC ..... 89/36.02; 89/917; 89/922

(58) Field of Classification Search

CPC ..... F41H 5/023; F41H 5/026; F41H 5/0492; F41H 5/00; F41H 5/007; F41H 5/02

USPC ..... 89/36.01, 36.02, 36.11, 36.12, 901, 89/902, 917, 939, 1.11, 36.04, 36.08, 922; 83/639.4; 296/187.07

See application file for complete search history.

(56) References Cited

U.S. PATENT DOCUMENTS 3,636,895 A * 1/1972 Kelsey ..... 109/78
3,950,584 A * 4/1976 Bramley ..... 428/113

(Continued)

FOREIGN PATENT DOCUMENTS

EP 0699887 3/1996
EP 1298407 4/2003

(Continued)

OTHER PUBLICATIONS

Israel Search Report from Israel Application No. 213972 mailed May 10, 2012.

(Continued)

*Primary Examiner* — Bret Hayes
*Assistant Examiner* — Derrick Morgan
(74) *Attorney, Agent, or Firm* — Dorsey & Whitney LLP

(57) ABSTRACT

An armor element configured to be employed within the armor module, the armor element being formed with a base portion and a claw portion. The armor element has a longitudinal axis oriented substantially perpendicular to the base portion, the claw portion comprising two or more claw members extending from the base portion generally along a longitudinal direction defined by the longitudinal axis. Each claw member has a rear end associated with the base portion and a front end spaced from the base portion. The claw members are tapered with respect to the longitudinal axis so that the distance between the corresponding front ends of the two or more claw members is greater than the distance between the rear ends of the two or more claw members.

9 Claims, 12 Drawing Sheets

(56) References Cited

U.S. PATENT DOCUMENTS

| | | | | |
|---|---|---|---|---|
| 4,179,979 | A | 12/1979 | Cook et al. | |
| 6,311,605 | B1 * | 11/2001 | Kellner et al. | 89/36.02 |
| 6,635,357 | B2 * | 10/2003 | Moxson et al. | 428/548 |
| 6,807,891 | B2 * | 10/2004 | Fisher | 89/36.02 |
| 7,383,762 | B2 * | 6/2008 | Cohen | 89/36.02 |
| 7,513,186 | B2 * | 4/2009 | Ravid et al. | 89/36.02 |
| 7,685,922 | B1 * | 3/2010 | Martin et al. | 89/36.02 |
| 7,938,053 | B1 | 5/2011 | Dudt et al. | |
| 8,074,554 | B1 * | 12/2011 | MacDougall | 89/36.17 |
| 8,096,224 | B2 * | 1/2012 | Martin et al. | 89/36.02 |
| 8,371,202 | B2 * | 2/2013 | Odhner et al. | 89/1.11 |
| 8,615,851 | B2 * | 12/2013 | Holmes et al. | 24/302 |
| 2005/0109234 | A1 * | 5/2005 | Lloyd | 102/497 |
| 2005/0115450 | A1 * | 6/2005 | Lloyd | 102/497 |
| 2006/0013977 | A1 | 1/2006 | Duke et al. | |
| 2006/0201318 | A1 * | 9/2006 | LaBrash et al. | 89/36.02 |
| 2006/0243127 | A1 * | 11/2006 | Cohen | 89/36.02 |
| 2007/0101892 | A1 * | 5/2007 | Rastegar | 102/502 |
| 2008/0236378 | A1 * | 10/2008 | Sane et al. | 89/36.02 |
| 2009/0078109 | A1 * | 3/2009 | Baxter et al. | 89/36.02 |
| 2009/0114083 | A1 * | 5/2009 | Moore et al. | 89/36.02 |
| 2010/0071537 | A1 * | 3/2010 | Weber et al. | 89/36.02 |
| 2010/0212484 | A1 * | 8/2010 | Williams et al. | 89/36.02 |
| 2010/0288114 | A1 * | 11/2010 | Soukos | 89/36.02 |
| 2011/0079135 | A1 * | 4/2011 | Farinella et al. | 89/36.02 |
| 2011/0162518 | A1 * | 7/2011 | Brill et al. | 89/36.17 |
| 2011/0192014 | A1 * | 8/2011 | Holmes et al. | 29/525.01 |
| 2013/0025442 | A1 * | 1/2013 | Lee | 89/36.02 |
| 2013/0228067 | A1 * | 9/2013 | McElfresh et al. | 89/36.02 |
| 2014/0033908 | A1 * | 2/2014 | Grozdanich et al. | 89/36.02 |

FOREIGN PATENT DOCUMENTS

| | | |
|---|---|---|
| EP | 1574810 | 9/2005 |
| EP | 1707913 | 10/2006 |
| EP | 1916495 | 4/2008 |
| EP | 1980813 | 10/2008 |
| WO | WO2006068721 | 6/2006 |
| WO | WO2008/105844 | 9/2008 |
| WO | WO2009/095903 | 8/2009 |

OTHER PUBLICATIONS

Israel Search Report from Israel Application No. 213397 mailed Apr. 30, 2012.

* cited by examiner

ARMOR ELEMENT AND AN ARMOR MODULE COMPRISING THE SAME

CROSS-REFERENCE TO RELATED APPLICATIONS

This application claims priority to Israel Patent Application No. 213397 filed on Jun. 6, 2011 and Israel Patent Application No. 213972 filed on Jul. 7, 2011, the contents of each of the foregoing applications are incorporated herein, in their entirety, by this reference.

TECHNICAL FIELD

The subject matter of the present application relates to armored systems, in particular to armored modules for protecting vehicles and structures.

BACKGROUND

Armored vehicle protection systems include means for withstanding the impact of shrapnel, bullets, missiles, or shells, and/or for neutralizing the triggering mechanism of weapons, such as Rocket Propelled Grenades (RPG). These protection systems are implemented in vehicles, such as tanks, Armored Personnel Carriers (APCs), aircraft, and ships, however may also be utilized to protect any stationary structures, such as a guard towers deployed around military bases, and army post, etc.

The protection system typically includes plates including material designed to absorb some of the impact, and/or elements configured for modifying the trajectory of the shell and/or neutralizing the triggering mechanism of the weapon. However these plates are often very heavy.

One example of a common weapon used against vehicles is an RPG, which is typically a shoulder-fired, anti-tank weapon system which fires rockets equipped with an explosive warhead.

FIG. 1 is illustrates one example of RPG warhead 10 having a conductive cone 12 encased in an aerodynamic cover 13. An electric trigger 11, which can be for example a piezoelectric fuze, is mounted at the top of aerodynamic c cover 13 and is coupled to the edge of the conductive cone 12. The warhead 10 further includes a body 16 filled with explosive 17 and a conductor 18, electrically coupled to conductive cone 12. Body 16 includes a conical liner 14 which is configured to focus the effect of the explosive's energy. The rocket 10 is propelled using a motor located in the tail section 19 thereof.

When the warhead 10 hits the target, the trigger 11 actuates an electric signal, which is transmitted through conductive cone 12 to conductor 18, which in return sets off the explosives 17. The explosive is then urged through an aperture in the conical liner toward the target.

Slat armor, which is also known as standoff armor, is a type of armor designed to protect against RPG attacks by neutralizing the triggering mechanism thereof. The slat armor includes a rigid grid deployed around the vehicle, which naturalizes the warhead, either by deforming the conical liner, or by short-circuiting the fuzing mechanism of the warhead. The slat armor is in the form of a rigid grid disposed in a predetermined distance from the vehicle, so as to allow the armor to come in contact with the cover of the RPG in order to neutralize it before the trigger hits the vehicle's body. The distance between the grid and the body of the vehicle is known as the standoff.

According to one example the slat armor includes a flexible mesh having rigid elements. The rigid elements are spaced from one another in such a way which does not allow an RPG warhead to hit the mesh without contacting at least one rigid element. Thus, the rigid element neutralizes the devastating effect of the warhead by deforming the conical liner and/or by short-circuiting the fuzing mechanism.

It is further known to suspend armor elements within a net. Under such an arrangement, the net is usually made of a crisscross grid of strings, and the armor elements are attached to the strings. It is also known to attach the armor elements to the net at junction points of such strings.

Some examples are known in which the armor elements are geometrically configured to work in conjunction with the net. For example, an armor element can have a first, solid body portion and a second body portion constituted by a plurality of petal members extending away from the solid body portion. Specifically, the armor element is mounted onto the net so that the strings of the net are received between the petal members, facilitating easier mounting of the armor elements onto the net. One example of such an armor element is disclosed in US 2011/0079135.

SUMMARY

According to the subject matter of the present application there is provided a stand-off armor module for mounting to a body to be protected, the armor module including a front portion having a carvable polymeric material with armor elements disposed in seats formed in the material by its cutting or carving, the armor elements constituting an operative armor layer of the armor module; the armor module further including a rear portion also having a carvable polymeric material and a rear end configured for facing the body to be protected when the module is mounted thereon, the rear portion providing a stand-off between the operative layer and the body, wherein the rear end of the rear portion can be carved to a desired shape for mounting on a body.

According to another aspect of the disclosed subject matter, the armor module can include only the operative layer comprising the carvable polymeric material including armor elements disposed in seats formed therein, wherein the operative layer is positioned at a distance from the body to be protected forming an air-gap between the operative layer and the body, constituting the stand-off.

The carvable polymeric material of the front portion and/or of the rear portion can be a shape retainable material, such as for example cellular or porous material, in particular, a foam material. The density of the material is essentially lower than that of the armor elements. In particular, the density of the material can be lower than 50%, more particularly, lower than 30% and still more particularly, lower than 10% of that of the armor elements. Exemplary values of the density of the material do not exceed $$250\ \frac{\mathrm{Kg}}{\mathrm{m}^3}.$$

This material can be, for example, of any of the following groups: closed cell foam, EVA foam and molded foam. Exemplary materials can be Styrofoam, Polyethylene (PE) foam, etc. Alternatively, the polymeric material can be a light-weight rubber based material.

The rear portion can be made of the same material as that of the front portion. Furthermore, the rear portion and the front portion can be formed as a unitary body. Moreover, both or any one of the front and rear portions can comprise more than one polymeric carvable material. The front portion can be attached to the rear portion by any suitable means, e.g. by adhesive.

If stand-off between the operative layer and the body to be protected is not provided by a rear portion interposed therebetween, stand-off can be provided by a support construction attached to the body to be protected, to which the operative layer can be attached or mounted.

According to one design, the support construction can be in the form of struts or bars extending between the operative layer and the body to be protected, and configured for holding to operative layer at a stand-off. The arrangement can be such that each of the struts/bars has a first point attached to the body to be protected and a second point attached to the operative layer.

According to another design, the operative layer can be configured for being displaceable along the struts/bars in order to allow varying the stand-off distance. For example, the struts/bars can be provided with rails along which the operative layer is configured to displace towards and away from the body to be protected. Alternatively, the operative layer can be provided with hooking elements (e.g. rings, clasps) configured for engagement with the struts/bars to be suspended therefrom and slidable therealong.

According to a particular design, the support construction can be made of the same material as that of the front portion, and can be in any shape configured for securely maintaining the operative layer in its desired position. It is appreciated that the support construction, when made of the same material as the operative layer, can still be reinforced with additional constructional elements (e.g. internal rigid rods/struts) for better support of the operative layer.

The armor elements can be seated in the material of the front portion with or without an adhesive. The front portion can comprise a layer formed with through-going holes in which the armor elements are retainably held within, the holes being carved-out of the material of the front portion. Alternately, the seats can be in the form of blind holes or, in case the polymeric material of the front portion is elastic, the armor elements can be positioned within slits formed in the material of the front portion, wherein the elasticity of the material allows expanding the slits in order to position the armor elements therein.

Due to the carvability of the material of the front portion, forming the seats for the armor elements can be carried out by simple cutting instruments such as a knife (a utility knife, a Stanley knife, boxcutter, X-Acto knife etc.

The armor elements can be in the form of pellets, cylinders, polygonal bodies, spheres or even of arbitrary shapes. The armor elements can also be configured for electrical conductivity for short-circuiting the fusing mechanism of a warhead such as RPG.

The armor module can further include a cover layer configured to be fitted to a front end of the front portion, and configured for retaining the armor elements in place.

The armor module can comprise a covering configured to cover the front portion and/or the rear portion so as to confine the unit within the covering. The covering can also be used to hold the front and rear portions together. The covering can be made of a water resistant material and/or anti-vandalism material so as to protect the module accordingly. The covering can be a single covering piece or can be made of several covering pieces attached to each other or to the front/rear portions of the module. In any case, the covering can be made of a water resistant material, and at least its front portion can further have anti-vandalism properties.

The presently disclosed subject matter further provides a method for forming a stand-off armor module. The method includes providing a front portion including a carvable polymeric material, forming seats configured for accommodating armor elements within the front portion by carving it, and placing armor elements within the seats to form an operative layer. The method further includes providing a rear portion having a rear end configured for facing the body to be protected when the module is mounted thereon, the rear portion provides a stand-off between the operative layer and the body. The rear portion can also be made of a carvable polymeric material and its rear end can be shaped by carving it in accordance with a surface on the body to be protected, to which the module is to be attached. The module can have such rear portion with the front portion in which the seats are made by a method different from that described above.

In accordance with another aspect of the subject matter of the present application, there is provided an armor element configured to be employed within the armor module of the previous aspect, the armor element being formed with a base portion and a claw portion, the claw portion comprising two or more claw members extending from the base portion, each claw member having a rear end associated with the base portion and a front end spaced from the base portion, wherein the distance between the corresponding front ends of the two or more claw members is greater than the distance between the rear ends of the two or more claw members.

The base portion may be inscribed within a circle having a center at O, and a central axis X can be defined extending through point O perpendicular to a plane defined by the inscribing circle.

In particular, the arrangement can be such that the claw members are angled to one another to provide the claw portion with a tapering angle with respect to the base portion. In addition, at least some of the claw members can define an inscribing cone the central axis of which is collinear with the central axis X, the cone of the angle being defined by the tapering angle of the claw portion. Specifically, due to the tapering angle, a cross section of the cone spaced from the base portion and associated with the front ends of claw members will be of a larger diameter than a cross section of the cone immediately adjacent the base portion and associated with the rear ends of claw members.

According to a specific design, the claw portion can comprise several sets of claws, each set defining an individual inscribing cone having its own cone angle.

The claw members of the claw portion are configured for penetrating the projectile upon impact therewith. Therefore, the tapering angle should be chosen such that upon impact of the projectile, the claw members have sufficient support from the base portion along the direction of the central axis. Thus, upon impact with the projectile, the external surface of the projectile will be the first to yield (i.e. become penetrated).

Specifically, the angle between each claw member and the central axis can be chosen to be no greater than 50°, more particularly no greater than 40°, even more particularly no greater than 30°, still more particularly no greater than 20° and yet more particularly no greater than 10°. Correspondingly, the tapering angle between two or more claws (i.e. cone angle) can be chosen to be no greater than 100°, more particularly no greater than 80°, even more particularly no greater than 60°, still more particularly no greater than 40° and yet more particularly no greater than 20°.

Further considerations regarding the tapering angle will be discussed later with respect to the operation of the armor elements during impact with the projectile.

Additionally, the claw members can be symmetrically located about the central axis X, i.e. be equally spaced about the central axis X. In case the claw portion comprises several sets of claw members, the claw members of at least one of the sets can be equally spaced about the central axis X.

Each of the claw members can be formed with a plurality of edges, facilitating more efficient penetration into the projectile. In particular, each claw member can defined by surfaces (either curved or planar), the edges being formed at the intersection between two or more of the surfaces.

Any one of the claw members can be of a general prism form, the surfaces defining the prism. Specifically, each such claw member can be formed with any one of the following:

- an external surface associated with the inscribing cone and extending about the circumference of the claw portion;
- one or more side surfaces extending generally radially from the external surface towards the central axis; and
- a front surface (associated with the front end of the claw member) extending between the side surfaces and the external surface The claw member can be formed such that at least the front end of the claw member is formed with at least one edge, which lies on a place generally perpendicular to the central axis of the armor element. It should be noted that having such a front edge can facilitate increasing the expected surface contact between the armor element and the external surface of the projectile (as opposed to claw members which are of a spike/point configuration).

The front surface of the claw member can be slanted with respect to both the central axis each of the external and/or side surfaces. In particular, the front surface can be slanted such that the edge it forms with the external surface is an edge of the front surface being most spaced from the base portion.

When two or more claw members are formed with such a front surface, an auxiliary tapering angle can be defined between their corresponding front surfaces, this tapering angle being greater than the tapering angle between the claw members.

Specifically, the auxiliary tapering angle can be no greater than 120°, more particularly no greater than 100°, even more particularly no greater than 80°, still more particularly no greater than 60° and yet more particularly no greater than 40°.

According to one specific design, the claw member can be in the form of a triangular prism having a curved external surface, two side surfaces angled to one another to form the triangular shape of the prism and a front surface bordering both the external surface and the side surfaces. According to such a design, the tapering angle can be about 10° and the auxiliary tapering angle can be about 90°.

The base portion can be in the form of a polygonal prism, e.g. of rectangular, square, triangular, hexagonal and even circular cross-section.

In assembly within the armor module, the armor element can be arranged such that the base portion thereof faces the body to be protected while the claw portion thereof faces the anticipated direction of the incoming projectile. More particularly, the armor element can be arranged so that the central axis thereof is parallel to the anticipated impact direction.

The armor element can be configured for mounting into the matrix of the armor module as previously described with respect to the first aspect of the disclosed subject matter. In this case, the armor element is fitted into the carvable polymeric material and is retained there by friction with the material.

Alternatively, the armor element can also be configured for mounting onto a grid surface being formed of a plurality of intersecting lines forming cells therebetween. Specifically, the armor element can be design such that the base portion thereof is slightly larger than one of the cells, so that it can be tightly fitter therein.

The arrangement can be such that the base portion is inserted into such a cell, under tight engagement, while the claw portion of the armor element protrudes from the grid surface in a direction towards the incoming projectile. In such a case, the tapering angle of the claw portion serves and additional function of preventing the armor element from escaping through the grid cell upon impact of the projectile thereupon.

In design of the armor module, it is usually desired, on the one hand, to reduce as much as possible the area of the armor elements so as to reduce the odds of operating the fuze of the incoming projectile, and on the other hand, to make sure that the external surface of such a projectile is penetrated by at least one armor element.

Thus, the tapering angle of the claw members of the armor element is chosen so that the claw portion does not significantly increase the area of the armor element in comparison with the area taken by the base portion. In other words, the diameter $D_{CLAW}$ of the inscribing circle defined by the front ends of the claw members is not significantly greater than the diameter $D_{BASE}$ of the inscribing circle of the base portion.

The ratio $D_{CLAW}/D_{BASE}$ can be no greater than 2, particularly no greater than 1.5, more particularly no greater than 1.2, even more particularly no greater than 1.1 and still more particularly no greater than 1.05.

Notwithstanding the above, in operation of the armor module with the above armor elements, it is still desired to increase the odds of the armor element to penetrate the external surface of the projectile. It should be understood that, on the one hand, the tapering angle should be sufficiently small so as not to increase the area of the armor element, and on the other hand, it should be sufficiently big so as to prevent "brushing/bounding off" of the armor element from the projectile. In particular, the tapering angle can reduce the odds of the claws simply sliding along the projectile and deforming radially inwardly towards the central axis. In such a case, the armor element might simply "brush/bounce off" the external surface of the projectile without reaching the desired effect of penetrating and neutralizing it.

BRIEF DESCRIPTION OF THE DRAWINGS

In order to understand the subject matter of the present application and to see how it may be carried out in practice, embodiments will now be described, by way of non-limiting example only, with reference to the accompanying drawings, in which.

DETAILED DESCRIPTION OF EMBODIMENTS

Figure 1:
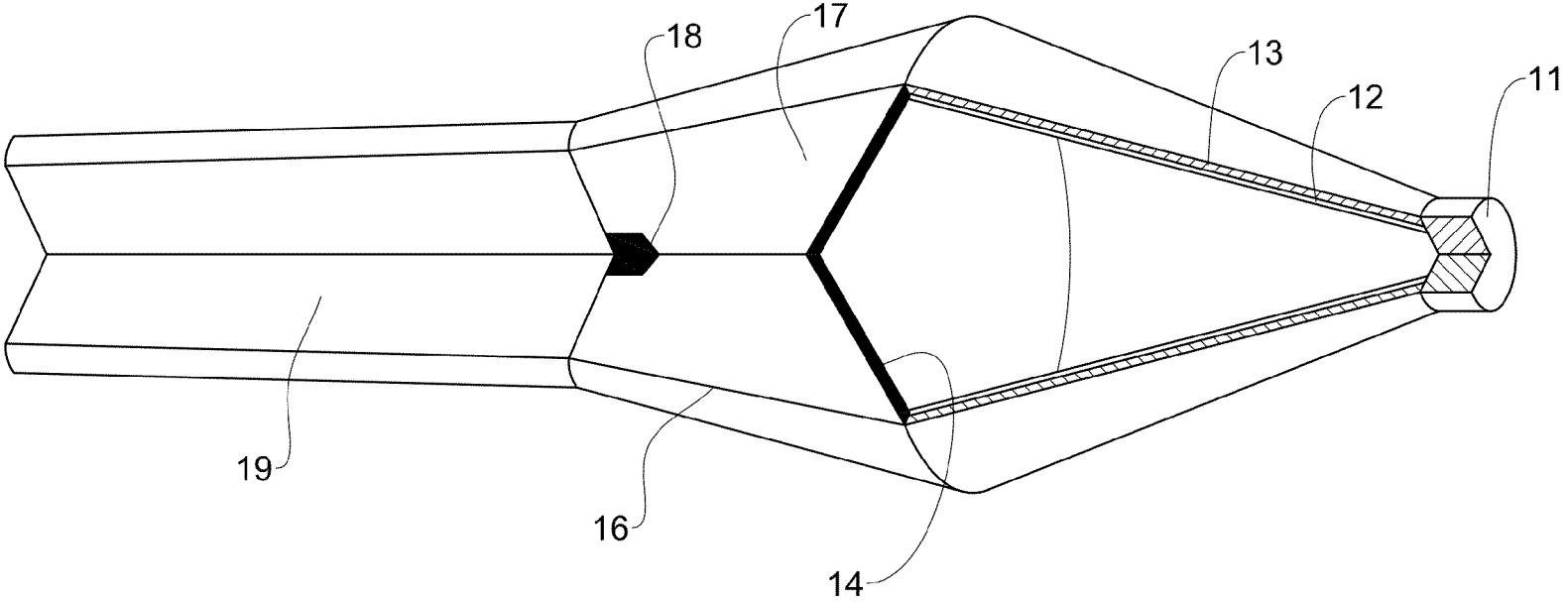
FIG. 1 is a schematic longitudinal isometric cross-sectional view of a prior art RPG missile.
Figure 2:
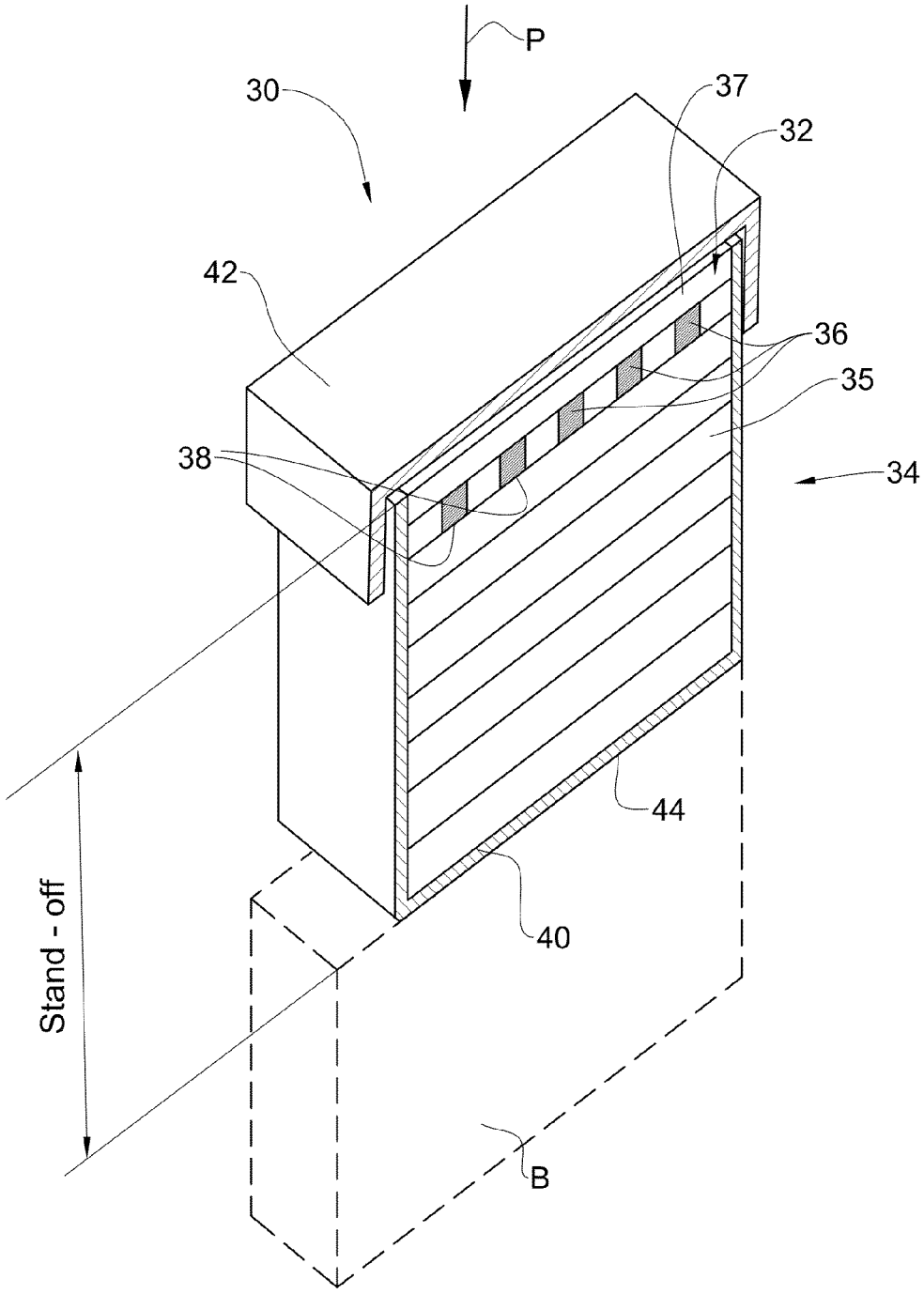
FIG. 2 is a top isometric view of an armor module constructed and operative in accordance with one example of the presently disclosed subject matter.

With reference to FIG. 2, a top isometric view of an armor module is shown, generally designated as 30 and comprising a front portion 32, and a rear portion 34. The front portion 32 includes a carvable polymeric material having a plurality of armor elements 36 positioned therein, and also includes a cover layer 37 configured to be fitted to a front end of the front portion, and configured for preventing disengagement of the armor elements 36. The rear portion 34 creates a stand-off between the armor elements and the body to be protected B.

Both the front portion 32 and the rear portion 34 are made of a polymeric material which can be a shape retainable material, providing both the convenience of forming the seats for the armor elements. The polymeric material can be cellular or porous material, in particular, a foam material. The density of the material is essentially lower than that of the armor elements. In particular, the density of the material can be lower than 50%, more particularly, lower than 30% and still more particularly, lower than 10% of that of the armor elements. Exemplary values of the density of the material do not exceed $$250\ \frac{\text{Kg}}{\text{m}^3}.$$

This material can be, for example, of any of the following groups: closed cell foam, EVA foam and molded foam. Exemplary materials can be extruded polystyrene, Styrofoam, Polyethylene (PE) foam (Palciv®), etc. Alternatively, the polymeric material can be a light-weight rubber based material.

In particular, the material from which the front portion is made can also have the following parameters:

| Property | Value |
|---|---|
| Tensile Strength | ≤350 kPa |
| Elongation | ≤200% |
| Compression 10% | ≤50 |
| Compression 25% | ≤70 |

-continued

| Property | Value |
|---|---|
| Compression 50% | ≤150 |
| Shore-OO | ≤80 |

The width of rear portion 34 defines a distance between the front portion 32 and the vehicle's body, so as to provide a stand-off distance between the operative layer and the body. It is appreciated that the rear portion 34 can include one layer substantially filling up the gap between the front layer 32 and the body. Alternatively, rear portion 34 can include more than one layer, from the same carvable material or from any other material, or may include a plurality of layers with spaces there between. According to another example, the rear portion 34 can include side walls on which the front portion 32 is mounted, and a space defined between the front wall 32 and the vehicle's body.

The rear portion 34 further includes a rear end 40 configured for facing the body to be protected when the module is mounted thereon. The rear end 40 can be carved to any desired shape, so as to allow mounting the armor module 30 on the vehicle's body. For example, the rear end 40 can have a shape substantially corresponding to the outer shape of the vehicle's body, thus allowing providing the vehicle with an optimal protection from all directions.

The front portion 32 of the armor module 30 is covered by a first covering piece 42 and the rear portion 34 can be covered by a second covering piece 44. The second covering piece 44 can be made of a material configured for providing weather/water resistance, while the first covering piece 42 can be made of a material having, on top of weather/water resistance, also an anti-vandalism characteristic.

For example, the covering material can be constituted by a combination of various materials with the following percentages:

| Material | Value (%) |
|---|---|
| Cotton | ≤15 |
| Para Aramid | ≤10 |
| Steel | ≤4 |
| Polyamid | ≤1 |
| Plyurethane | ≤8 |
| PVC | ≤40 |
| Foam | ≤5 |
| Synthetic fibers | ≤25 |

In the armor module of the present example, the second covering piece 44 surrounds the front and rear portions 32, 34 from the rear end 40 and from the sides, while the first covering piece 42 covers a front end of the front portion 32 as well as a portion of the second covering piece 44 at the sides of the armor module 30.

The first covering piece 42 and the second covering piece 44 can be attached to one another by various means including adhesive, Velcro®, hook and loop arrangement, snap attachment etc. In addition, it is appreciated that the first covering piece 42 and the second covering piece 44 can be attached to each other tightly enough so as to firmly hold therein the front and rear portions 32, 34, thereby eliminating the need to use and adhesive between the covering pieces 42, 44 and the portions 32, 34.

According to one example the rear portion is made of the same material as that of the front portion, and according to a yet a further example, the rear portion and the front portion are formed as a unitary body. Moreover, both or any one of the front and rear portions can comprise more than one polymeric carvable material. The front portion can be attached to the rear portion by any suitable means, e.g. by adhesive.

According to a further example, the cover may be configured to protect the module from the heat, UV radiation, etc. It is appreciated that the cover of the module is not configured to activate the trigger of the shell, so as to allow the armor elements 36 to deform the warhead before the trigger is activated.

The module 30 can further include a rear cover 44, for covering the rear end 40. Rear cover 44 can include mounting means (not shown) for mounting on the body to be protected, such as the vehicle's body. For example, rear cover 44 can include Velcro straps for mounting on corresponding Velcro straps on the vehicle. Alternatively, the rear cover 44 can include a layer of adhesive material for example adhesive tape for affixing to a vehicle's body.

According to one example, the covering configured to cover the front portion and/or the rear portion so as to confine the unit within the covering. The covering can also be used to hold the front and rear portions together.

The covering can be a single covering piece or can be made of several covering pieces attached to each other or to the front/rear portions of the module.

The armor module can be manufactured as a unitary block having a front layer with armor elements. The block can be mounted on a vehicle by merely carving the rear end 40 thereof, to match the shape of the body to be protected. This way the armor module does not have to be custom made for the specific vehicle has the way conventional slat armor are manufactured.

The armor elements 36 are rigid elements configured to engage and deform the outer surface of the warhead of a striking projectile, thus, constituting an operative armor layer of the armor module 30. The armor elements can be in the form of pellets, cylinders, polygonal bodies, spheres or even of arbitrary shapes. According to one example the armor elements 36 are made of a conductive material, configured for short-circuiting the fuzing mechanism of the warhead.

Figure 2A:
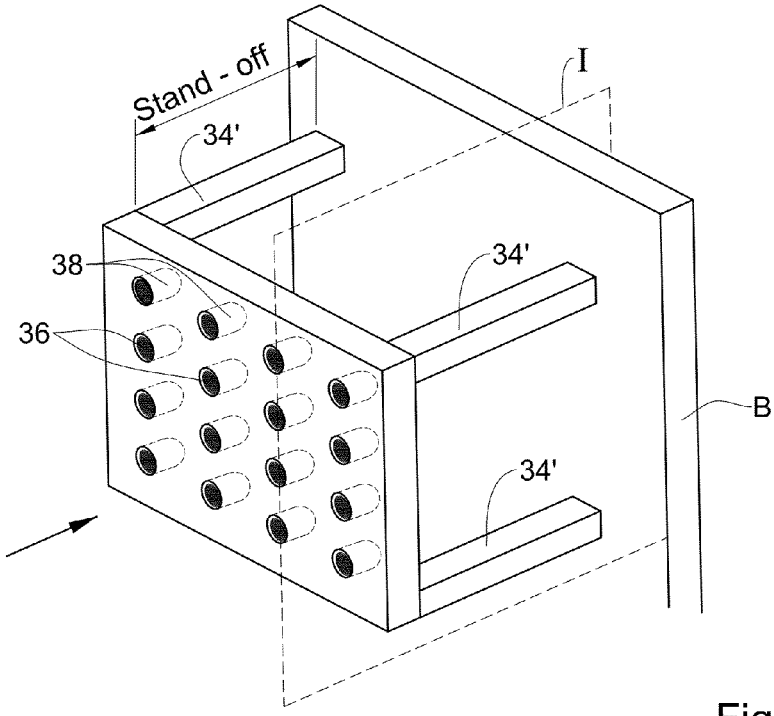
FIG. 2A is a schematic isometric view of another example of the armor module of the present application.
Figure 2B:
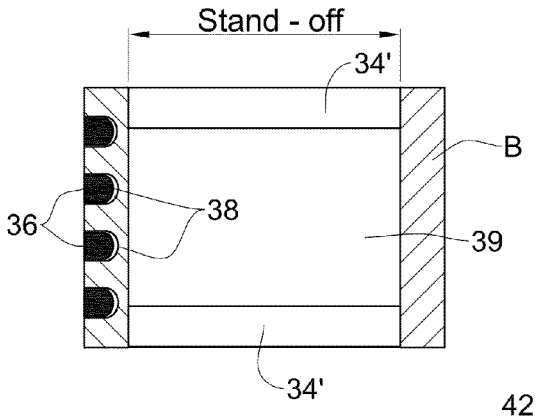
FIG. 2B is a schematic cross-sectional view of the armor module shown in FIG. 2A, taken along plane I-I.

Attention is now drawn to FIGS. 2A and 2B, in which another example of the armor module is shown. In the present example, the rear portion is replaced by a support construction constituted by four struts/bars 34' configured for providing the desired stand-off between the operative layer 32 and the body B in the form of an air-gap 39.

Each of the struts/bars 34' extends generally perpendicular to the body to be protected B and has a first end fixedly attached to the body to be protected and a second end fixedly attached to the operative layer 32.

Figure 2C:
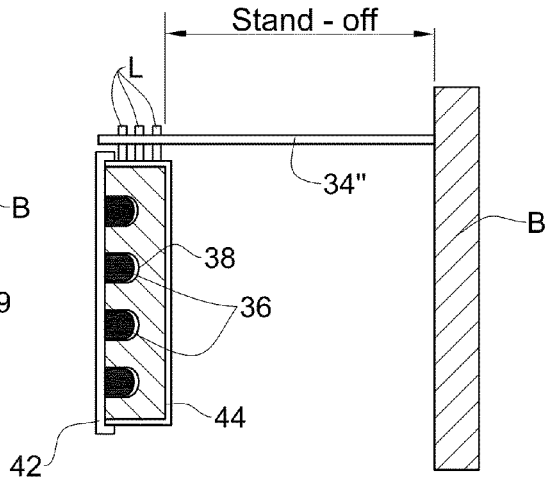
FIG. 2C is a schematic cross-sectional view of still another example of the armor module according to the present application.

Further attention is drawn to FIG. 2C, in which another support construction is shown, also made by struts/bars 34". However, in this example the operative layer 32, and more particularly the covering 42 of the operative layer 32 is provided with rings L which are configure for being mounted onto the struts/bars 34". Specifically, the struts/bars 34" are configured for being passed through the rings L so that the armor module 30 is suspended generally parallel to the body to be protected B and is slidable along the struts/bars 34 to effectively change the stand-off distance, if so desired.

Figure 3A:
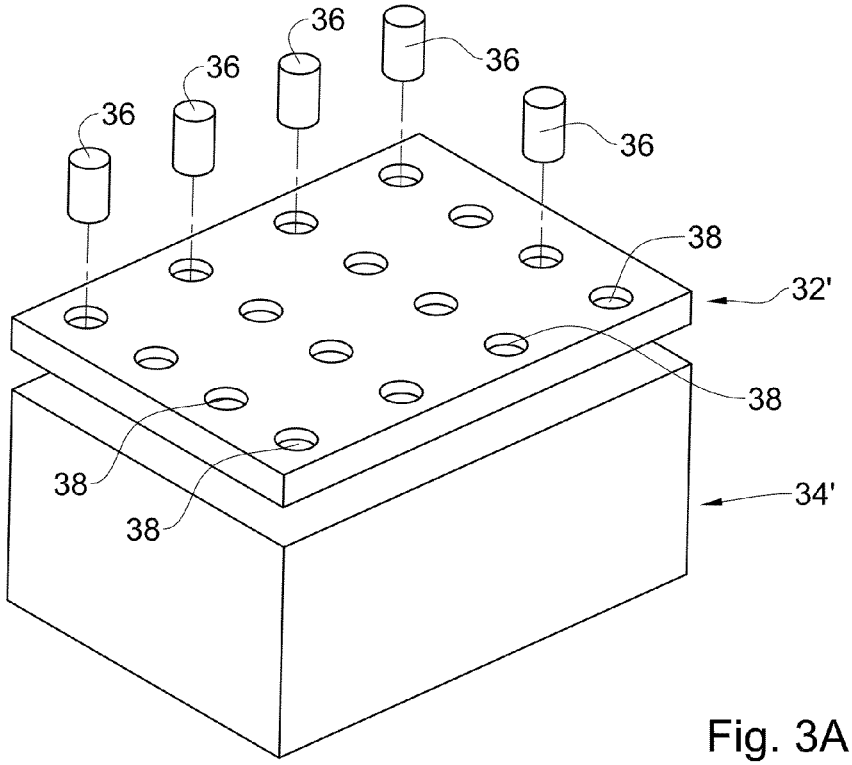
FIG. 3A is a schematic isometric view of an operative layer of the armor module shown in FIG. 2.

With additional reference being made to FIG. 3A, the armor elements 36 are disposed in seats 38 carved, or cut on front portion 32. The material of the front portion 32 is formed with through going holes 38 configured for accommodating therein the armor elements 36. It is appreciated that the holes 38 can be slightly smaller in their nominal dimension than that of the armor elements, thereby firmly retaining the armor element 36 within the hole once placed there. Thus, the armor elements can be seated in the material of the front portion with or without an adhesive.

Due to the carvability of the front portion 32, forming the seats 38 for each armor element 36 can be carried out on the spot for example, with a conventional cutting instrument, such as a knife, a utility knife, a Stanley knife, boxcutter, X-Acto knife, etc. Forming the seats can be carried out before or after mounting the armor module on the vehicle.

Figure 3B:
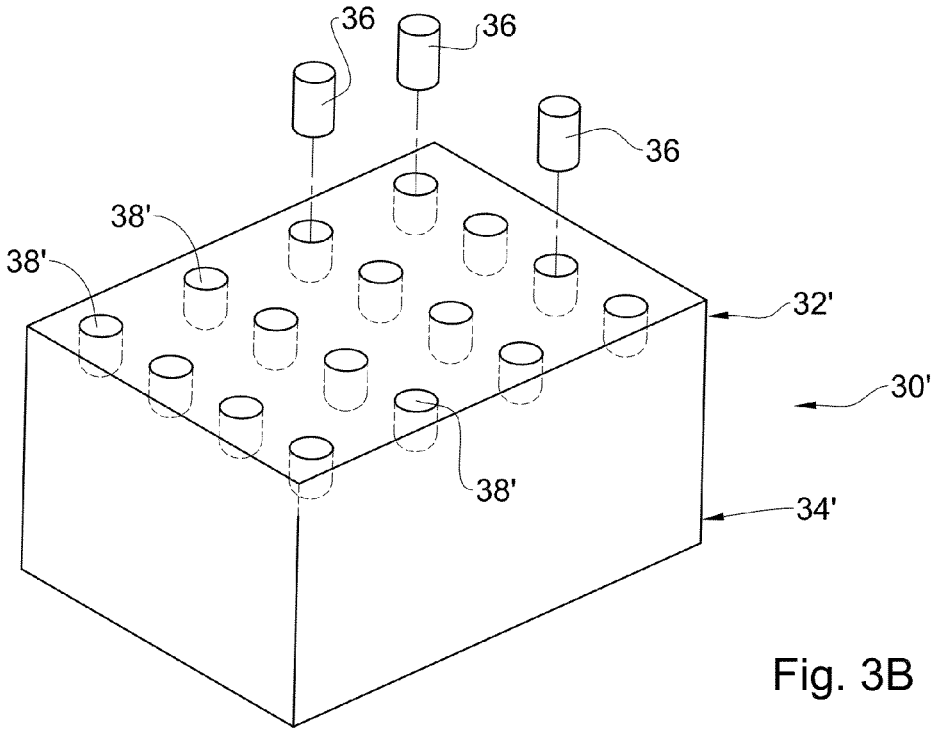
FIG. 3B is a schematic isometric view of an operative layer according to another example of the armor module.
Figure 4A:
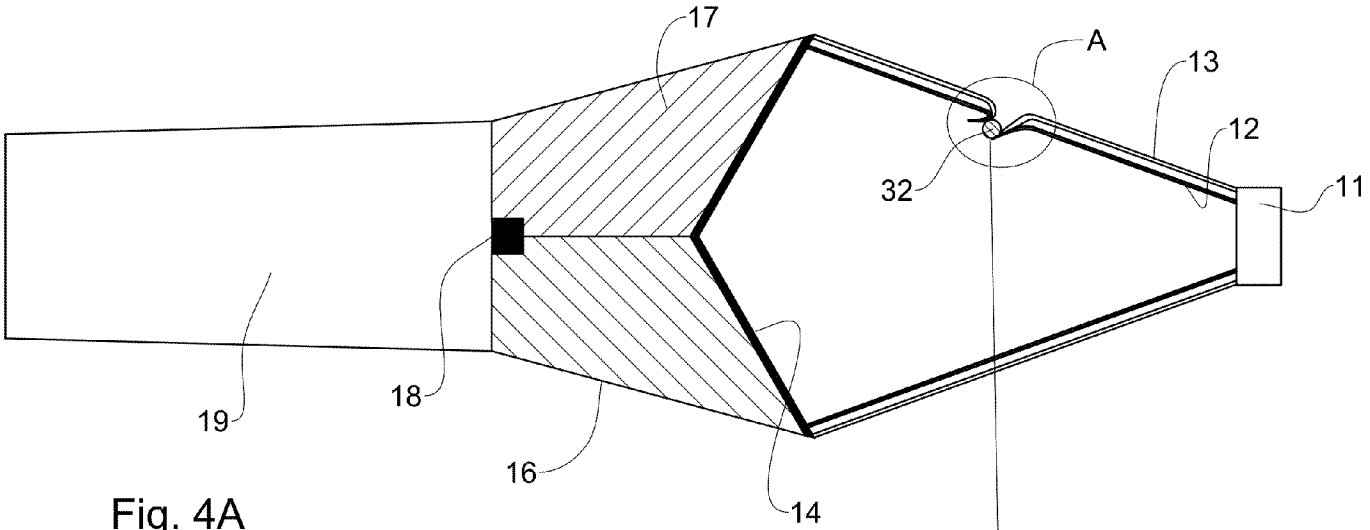
FIG. 4A is a schematic longitudinal cross-sectional view of the RPG missile shown in FIG. 1 when neutralized by the armor module of the present application.
Figure 4B:
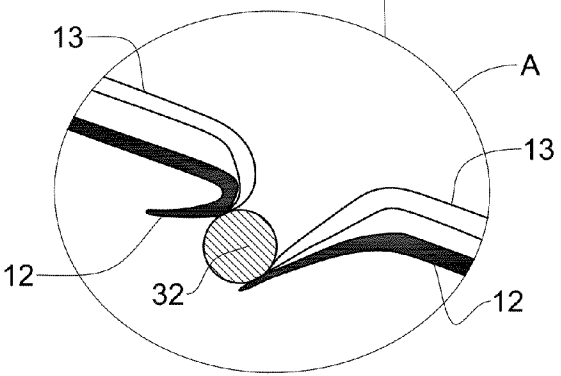
FIG. 4B is a schematic enlarged view of detail A shown in FIG. 4A.

With reference being made to FIG. 3B, another alternative of the armor module is shown in which the armor module 30' is made of a unitary piece of polymeric carvable material, so that the front portion 32' and the rear portion 34 constitute a single body.

Under the above example, the front portion 32' is made of pockets 38', open only at one side thereof, and configured for accommodating the armor elements 36. It should be appreciated that the armor module 30' can still be provided with a cover layer 37, and front and rear covering pieces 42, 44, similarly to the previously described armor module 30.

It is noted that the shape of the seats is not restricted to through going holes 38 or pockets 38'. For example, the armor module 30 can be provided with a plurality of precut slits configured for holding an armor element 36. The armor elements 36 can be inserted in each slit before or after mounting the armor module 30 on a vehicle, as required.

In operation, when a warhead, such as an RPG is shot at the vehicle, the trigger hits the front portion 32 first, due to the light and soft characteristics of the polymeric material the trigger is not activated. The warhead continues its penetration through the front portion 32 until the cover thereof engages the armor elements 36. Due to the relative rigidity of the armor elements 36, and the velocity of the warhead, the cover of the warhead is deformed, thereby short circuiting the trigger before the latter hits the side wall of the vehicle and/or damaging the conical liner.

Turning now to FIGS. 5A to 5F, an armor element is shown generally designated as 50, and differing from the previously described armor element 36 in its geometry. In particular, the armor element 50 is in the form of a crown/flower, and comprises a support base 52 and a claw portion 54.

The support base 52, according to this particular example, is in the form of a cylindrical portion having a central axis X, a rear surface 51 and a front surface 53. The support base 52 is configured for providing support for the claw portion 54 during impact of the projectile thereupon. The support base 52 can also be used for mounting the armor element 50 onto the grid/matrix in which the armor elements 50 are held in place.

The claw portion 54 of the armor element 50 comprises four claws (may also be referred herein as petals) 56, each extending from the front surface 53, generally along the axis X. However, the claws 56 are slightly angles to the central axis X so as to form a generally conical geometry (see FIGS. 5D to 5F). The advantages of such a conical geometry will be discussed in details later with respect to FIGS. 6A to 7C.

It is observed that each claw 56 has a generally triangular shape defined between two side surfaces 57 extending generally radially and angles to one another, a front surface 58 and an external surface 59. In this particular example, the side and front surfaces 57, 58 are planar, while the external surface 59 is curved, and is designed so that it merges with the cylindrical surface of the support base 52. It is also noted that the front surface 58 is a slanted surface, so that it is also angled to the central axis X (see FIG. 5E).

Between each two surfaces 57, 58, 59 of each claw 56, a corresponding edge is formed as follows:

edge 61 between the two side surfaces 57;

edge 63 between the front surface 58 and external surface 59;

edge 65 formed between each of the side surfaces 57 and the external surface 59; and edge 67 formed between each of the side surfaces 57 and the front surface 58.

It is noted that the edges 61, 63, 65 and 67 are sharp edges, increasing the ability of the armor element 50 to penetrate the RPG. Specifically, such a design allows the edges 61, 63, 65 and 67 to cut through the cover 13 and cone 12 of the RPG more effectively.

Figure 5A:
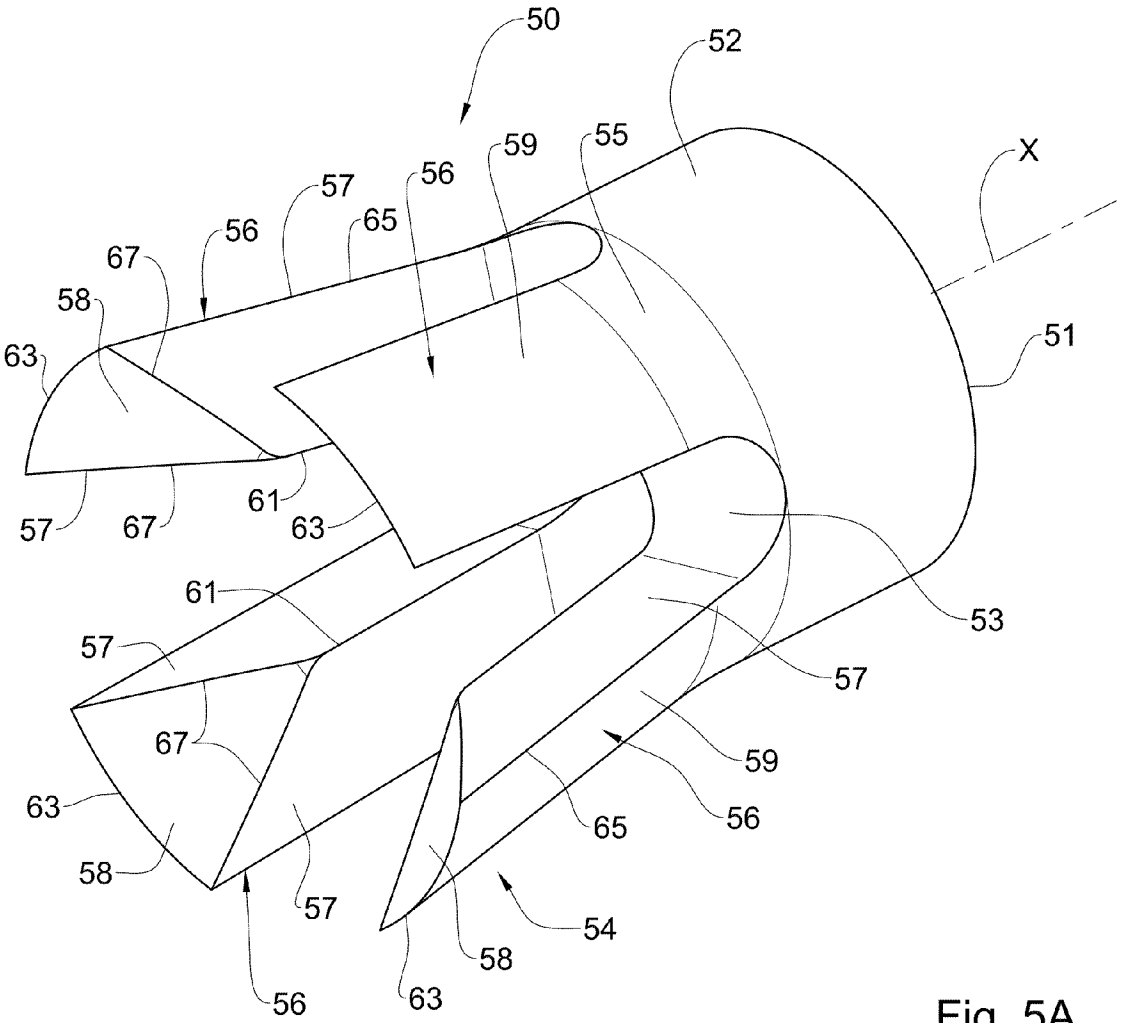
FIGS. 5A to 5D are schematic isometric, front, rear and side views of an armor element employed in the armor module of any of FIGS. 2 to 4B.
Figure 5B:
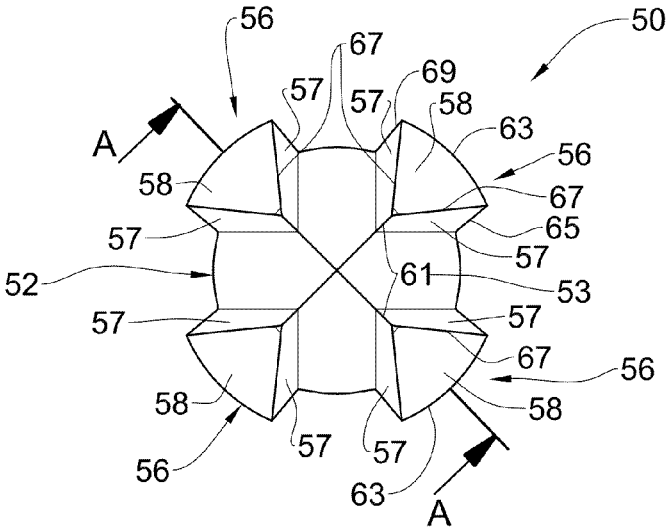
Figure 5C:
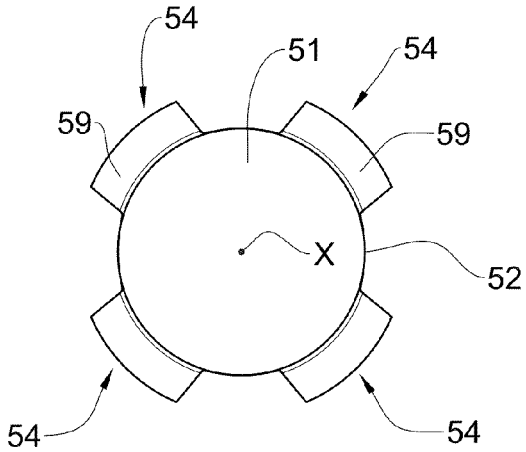
Figure 5D:
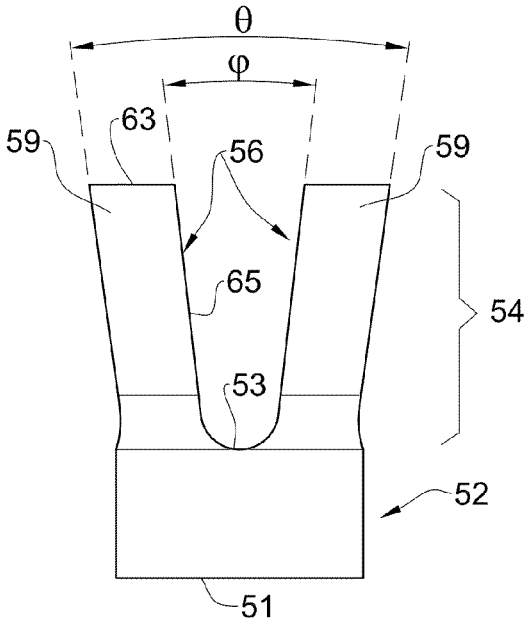
Figure 5E:
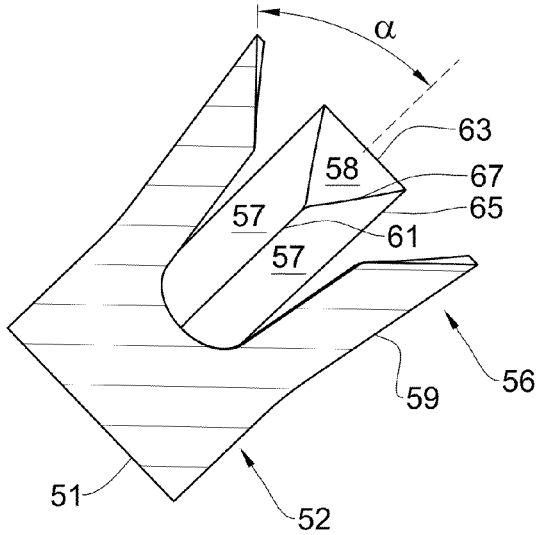
FIG. 5E is a schematic cross-sectional view taken along a plane A-A shown in FIG. 5B.

With particular reference now being made to FIGS. 5D and 5E, it is observed that due to the conical shape of the claw portion 54, the diameter $D_{CLAW}$ at a front end of the armor element 50 is greater than the diameter $D_{BASE}$ of the rear surface 53 of the support base 52 (23.13 mm as opposed to 19 mm).

Figure 5F:
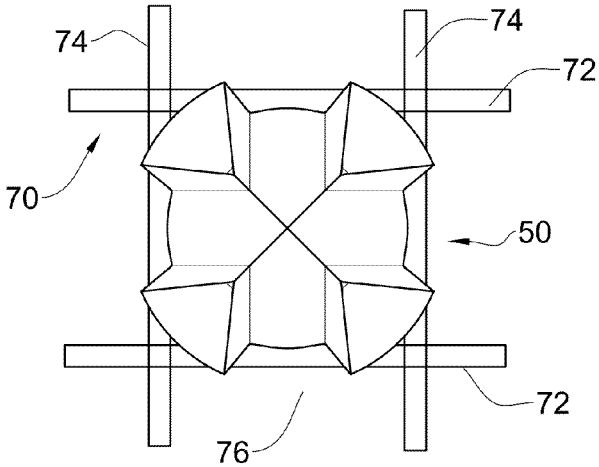
FIGS. 5F and 5G are schematic front and side views of the armor element shown in FIGS. 5A to 5D, when mounted onto a grid.
Figure 5G:
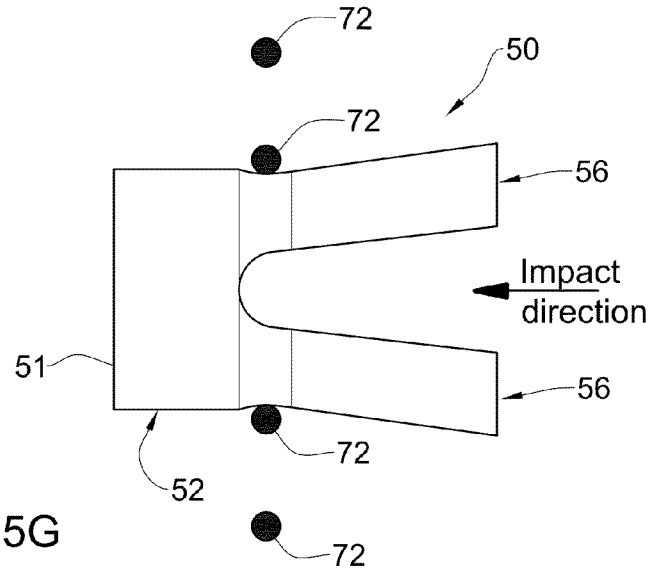

With reference to FIGS. 5F and 5G, the armor element 50 is shown when mounted onto a grid 70 formed by warp and weft strings 72, 74 respectively. The strings 72, 74 form the cells 76 of the grid 70. The arrangement is such that the diameter of the base portion 52 of the armor element 50 is slightly larger than the nominal dimension of the cells 76, so that it can be tightly fitted therein.

Due to the tapering angle of the claw portion 54 of the armor element, the armor element 50 is prevented from being pushed through the cell 76 of the grid 70 in the impact direction. Thus, the tapering angle of the claw portion 54 serves a double purpose—both for penetration of the RPG 10 and for preventing the armor element from being discharged from the cells 76 of the grid 70 upon impact with the RPG 10.

In the particular example of the armor element shown in FIGS. 5A to 5G, the armor element is formed with a transition portion 55 between the claw portion 54 and the base portion 52, having a diameter smaller than both portions 52, 54. Thus, the armor element 50 is firmly retained within the cell 76 of the grid 70 and is prevented from being discharged from the grid 70 both in the impact direction (towards the rear) as well as in the opposite direction (towards the front).

Experiments were carried out on an armor module 30 comprising the armor elements 50 and fired at with a projectile (in this particular example an RPG), in which the armor module 30 withstood the impact of the RPG. However, in such experiments, even in the case of a successful operation of the armor module 30, the RPG is mostly destroyed, making it difficult to examine the armor elements 50 and RPG after impact.

For this purpose, another set of experiments was performed, in which the RPG was held static which an armor element 50 was propelled (e.g. by a gas cannon or similar means) towards the RPG at an appropriate velocity in order to simulate the interaction between the RPG and the armor elements 50 during regular impact (as in the previously described experiments). These experiments are illustrated in FIGS. 6A to 7C.

Turning now to FIGS. 6A to 6E, these figures show different consecutive stages of interaction between the armor element 50 and the RPG 10 as explained below.

Figure 6A:
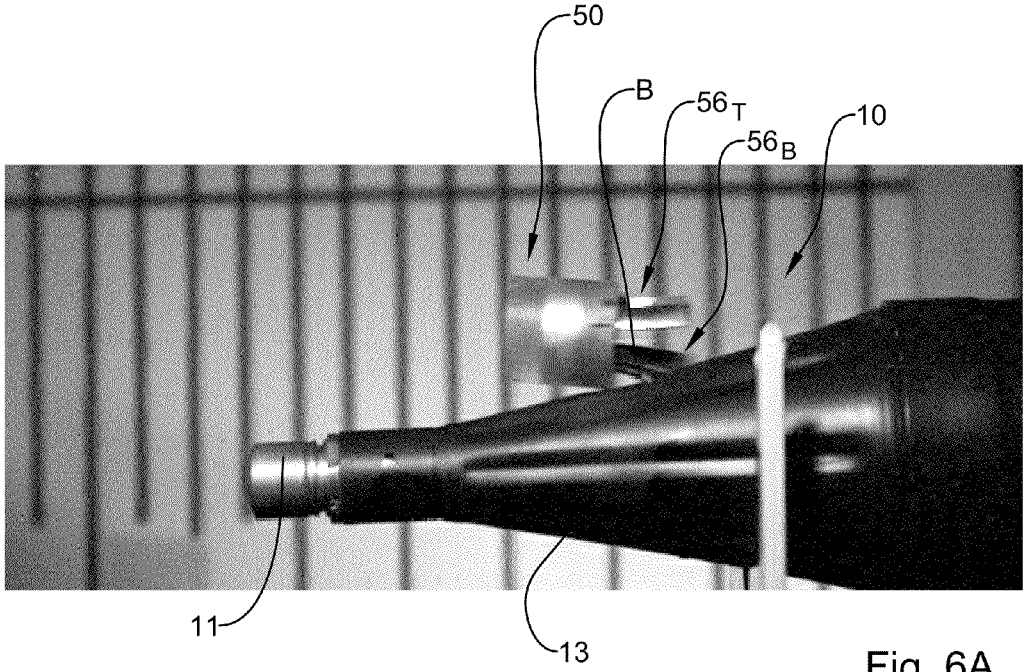
FIGS. 6A to 6E are photos showing consecutive stages of interaction between the armor element shown in FIGS. 5A to 5E and a projectile.

FIG. 6A demonstrates the moment of impact between the armor element 50 and the RPG 10. It is noted that in the position shown at that moment, the two bottom claws 56 of the armor element 50 contact the external cover 13 of the RPG 10 and begin penetrating it. In particular, the edge 63 is the first to contact the cover 13 so that the claw 56 begins to deform (see bending B) radially outwardly (i.e. widening of the conical shape).

It is noted here that the conical shape of the claw portion 54 of the armor element 50 increases the claw's likelihood to penetrate the RPG 10. More particularly, the conical design reduces the odds of the claw 56 simply sliding along the cover 13 of the RPG 10 and deforming radially inwardly towards the central axis X. In such a case, the armor element 50 might simply "bounce off" the cover 13 of the RPG 10 without reaching the desired effect of penetrating the cover 13 and neutralizing the RPG 10.

Figure 6B:
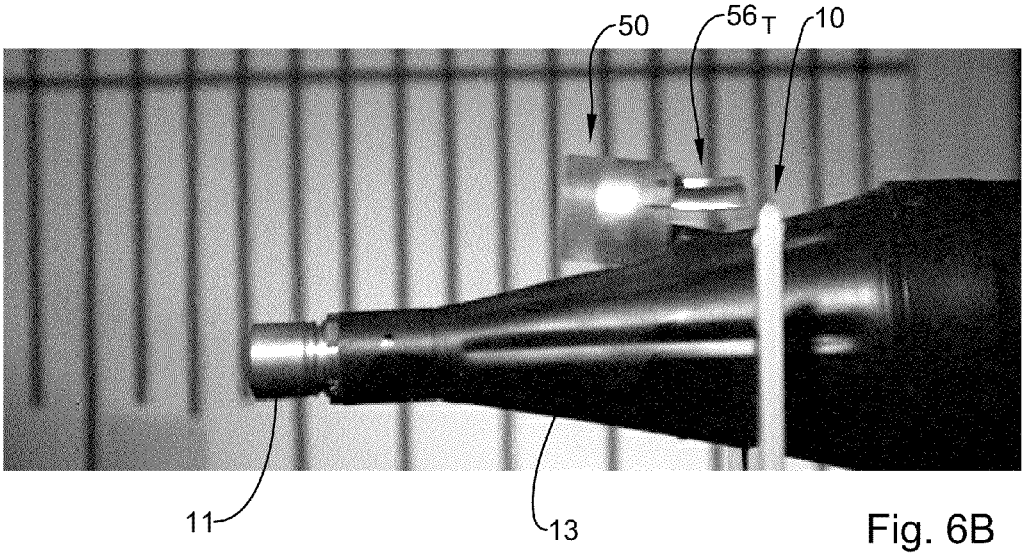
Figure 6C:
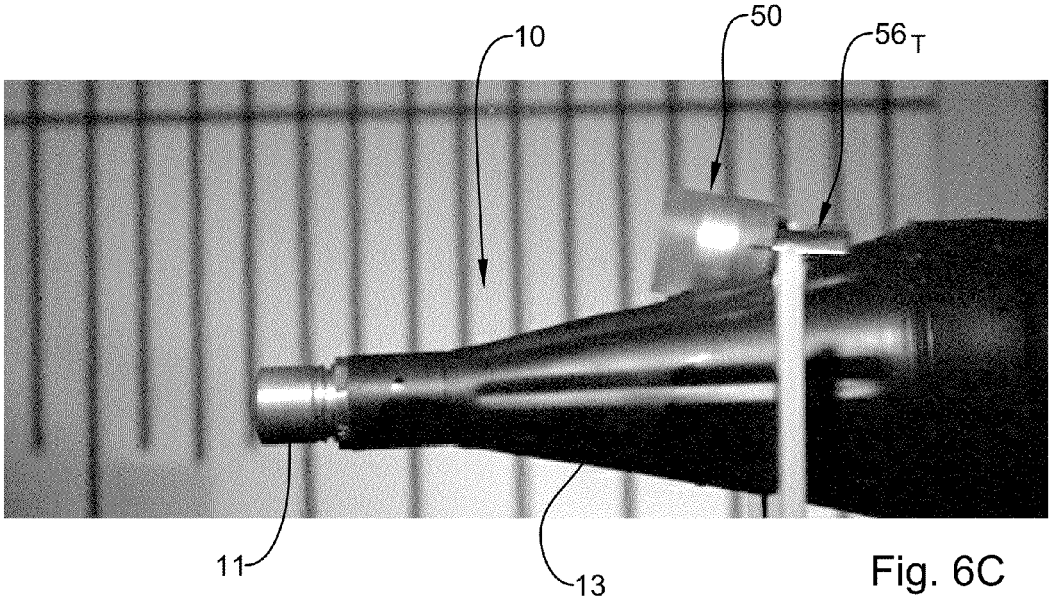

Reference is now made to FIGS. 6B and 6C, in which it is shown that the armor element 50 further penetrates the RPG 10, yet maintaining its general direction (i.e. the central axis of the armor element 50 is generally parallel to that of the RPG 10). In the position shown in these figures, the bottom claws 56 (fully penetrated into the RPG 10 and so not seen) are further deformed. It is appreciated that the more the claws 56 are deformed radially outwardly, the greater their extension in a direction perpendicular to a central axis of the RPG 10. Thus, due to its conical clawed design, the further the armor element 50 progresses, the deeper it penetrates into the RPG 10 (the term 'deep' referring to a direction perpendicular to the central axis of the RPG 10).

Figure 6D:
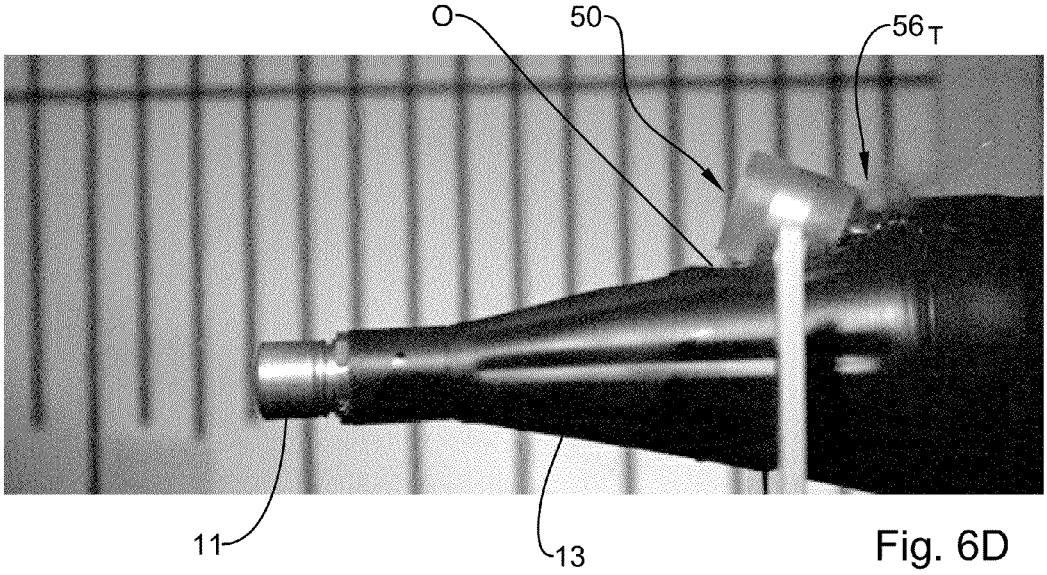
Figure 6E:
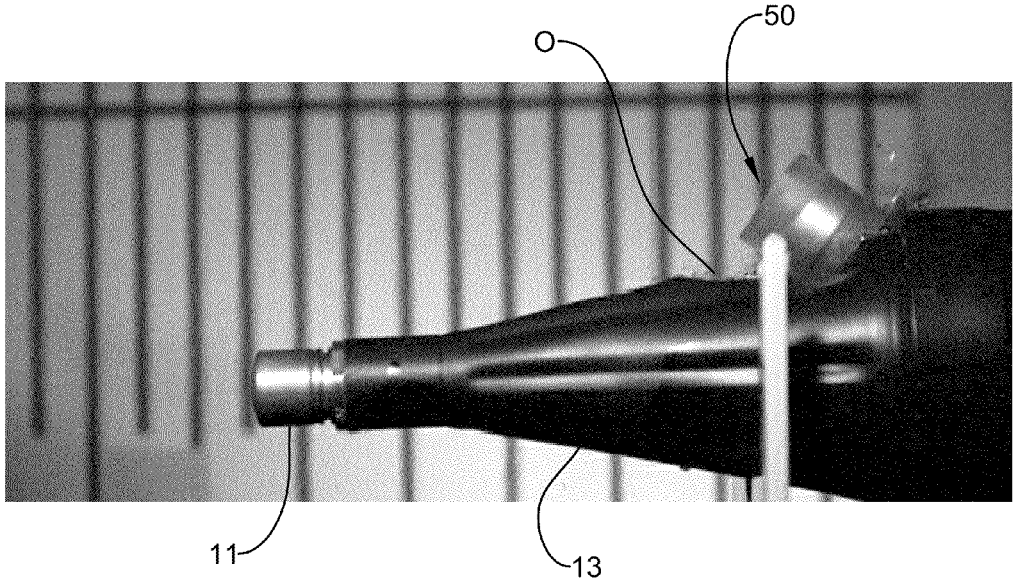

Turning now to FIGS. 6D and 6E, once the bottom claws 56 have penetrated into the RPG 10 to a sufficient amount, the bottom claws 56 are arrested within the RPG 10, causing the entire armor element 50 to turn about an axis perpendicular to the central axis X thereof, such that the top claws 56 begin penetrating into the RPG 10 as well.

With further reference to FIGS. 6D and 6E, it is observed that the armor element 50 tears apart the cover 13 of the RPG 10, leaving an opening O therein. It is appreciated that due to the design of the armor element 50, and in particular of the claw members 56, each claw member coming in contact with the external surface of the RPG 10 operates like a chisel, carving open the RPG's external surface.

Figure 7A:
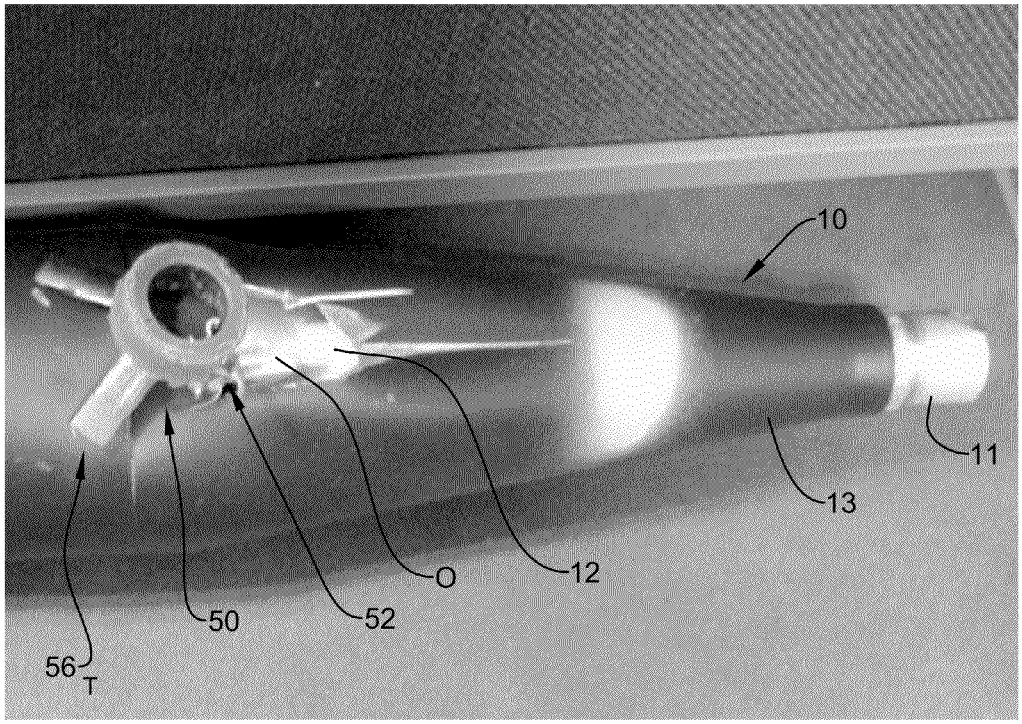
FIGS. 7A and 7B are photos of a projectile after being damaged by the armor element shown in FIGS. 5A to 5E in perspective and side views respectively.
Figure 7B:
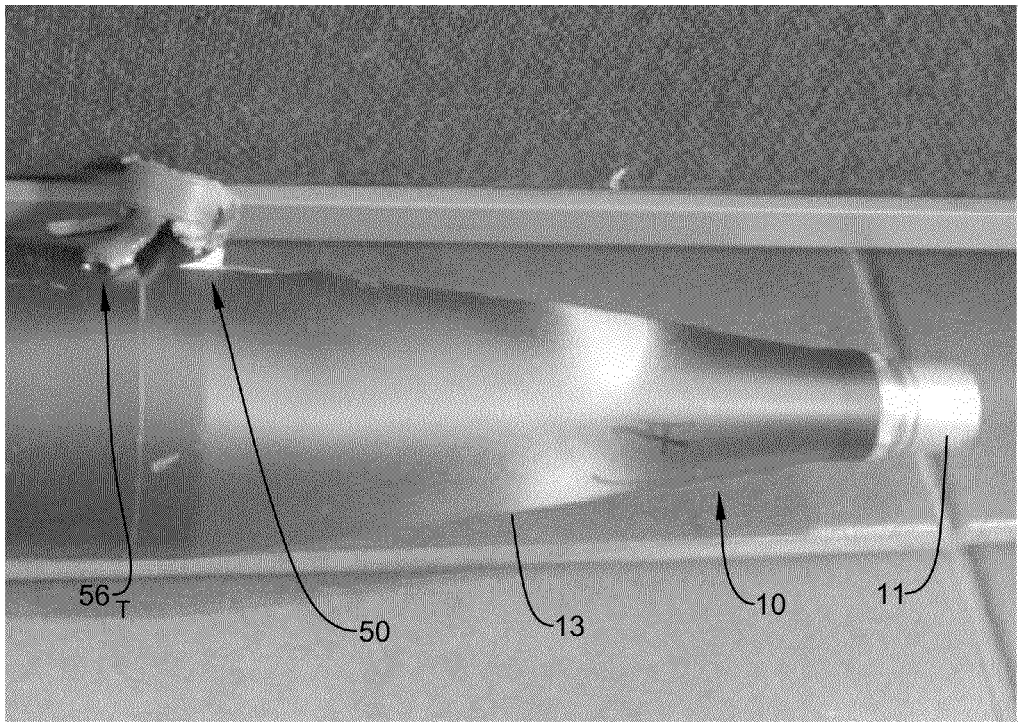

Turning now to FIGS. 7A and 7B, the RPG 10 is shown after penetration of the armor element 50 therein. It is observes that the bottom claws 56 are fully received within the body of the RPG 10, and that the top claws 56 are spread over the external surface of the RPG 10 partially penetrating it. It is also observed that the armor element 50 creates a considerable opening within the RPG 10, which is almost as big as the armor element 50 itself.

Figure 7C:
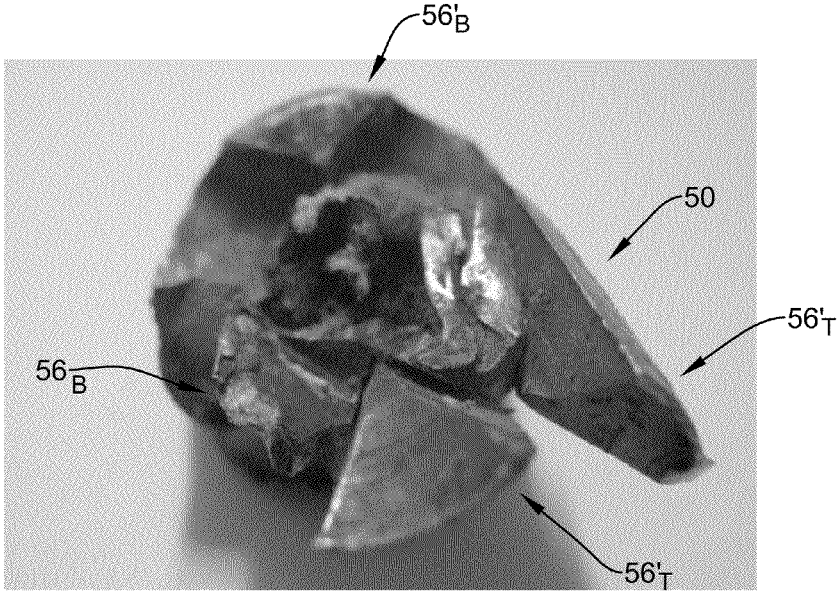
FIG. 7C is a photo of the armor element shown in FIGS. 5A to 5E after impact of a projectile.

Turning now to FIG. 7C, the armor element 50 is shown after being extracted from the RPG 10. It is observed that the top claws $\mathbf{56}_T$ are somewhat deformed, but generally maintain their original geometry, while the bottom claws $\mathbf{56}_B$ are almost completely destroyed as a result of the impact.

In ballistic experiments of RPG and similar projectiles, one of three results is usually achieved:

silent neutralization—the RPG is fully stopped by the armor module and the explosive material therein does not explode;

violent neutralization—the RPG is fully stopped by the armor module and the explosive thereof still detonates, but not properly thereby not forming a liquid jet as planned; and no neutralization—the armor module does not neutralize the RPG and a liquid jet is formed.

It should be noted that in the above performed experiments using a moving RPG and a static armor module 30, the armor module 30 demonstrated a much greater percentage of silent neutralizations as compared to violent neutralization. In particular, the percent of silent neutralizations was approximately 70% of all impacts.

Those skilled in the art to which this invention pertains will readily appreciate that numerous changes, variations, and modification can be made without departing from the scope of the invention, mutatis mutandis.

The invention claimed is:

1. An armor element configured to be employed within an armor module and exhibiting a longitudinal axis, the armor element comprising:

a base portion including a rear surface and a front surface axially spaced from the rear surface along the longitudinal axis;

a claw portion comprising two or more claw members, the two or more claw members extending from the base portion generally along a longitudinal direction defined by the longitudinal axis, each of the two or more claw members having a rear end attached to the base portion and a free front end spaced from the rear end thereof and located axially beyond the front surface of the base portion, each of the two or more claw members being supported only at the rear end thereof; and wherein the two or more claw members project radially outwardly with respect to the longitudinal axis so that an outer diametric distance between the corresponding free front ends of the two or more claw members is greater than an outer diametric distance between the corresponding rear ends of the two or more claw members.

2. The armor element according to claim 1, wherein an angle between each of the two or more claw members and the longitudinal axis is chosen to be no greater than 50°.

3. The armor element according to claim 1, wherein the two or more claw members are substantially symmetrically located and substantially equally spaced about the longitudinal axis.

4. The armor element according to claim 1, wherein each of the two or more claw members is formed with a plurality of edges, each of the two or more claw members is defined by surfaces, each of the plurality of edges being formed at an intersection between two or more of the surfaces.

5. The armor element according to claim 1, wherein the each of the two or more claw members is formed with any one of the following:

an external surface associated with an inscribing cone and extending about the circumference of the claw portion;

one or more side surfaces extending generally radially from the external surface towards the central axis; or a front surface associated with the free front end of the claw member, the front surface extending between the one or more side surfaces and the external surface.

6. The armor element according to claim 5, wherein, when the two or more claw members are formed with the front surface, an auxiliary tapering angle is defined between corresponding front surfaces of the two or more claw members, the auxiliary tapering angle being greater than a tapering angle between the two or more claw members.

7. The armor element according to claim 6, wherein the auxiliary tapering angle is no greater than 120°.

8. The armor element according to claim 1, wherein a diameter $D_{CLAW}$ of the inscribing circle defined by the free front ends of the claw members is not significantly greater than a diameter $D_{BASE}$ of the inscribing circle of the base portion.

9. The armor element according to claim 8, wherein the ratio $D_{CLAW}/D_{BASE}$ is no greater than 2.

* * * * *